US007540490B2

(12) United States Patent
Suzuki et al.

(10) Patent No.: US 7,540,490 B2
(45) Date of Patent: Jun. 2, 2009

(54) BANKNOTE HANDLING DEVICE

(75) Inventors: Mikio Suzuki, Kaizuka (JP); Hiroyuki Shibao, Kashihara (JP)

(73) Assignee: Laurel Machinery Co., Ltd., Osaka (JP)

( * ) Notice: Subject to any disclaimer, the term of this patent is extended or adjusted under 35 U.S.C. 154(b) by 372 days.

(21) Appl. No.: 11/298,578

(22) Filed: Dec. 12, 2005

(65) Prior Publication Data

US 2006/0125173 A1 Jun. 15, 2006

(30) Foreign Application Priority Data

Dec. 14, 2004 (JP) ..... P2004-361142

(51) Int. Cl.
*B65H 1/08* (2006.01)
*B65H 3/52* (2006.01)

(52) U.S. Cl. ..... 271/126; 271/121; 271/125; 109/45; 902/9

(58) Field of Classification Search ..... 271/10.09, 271/10.11, 121, 122, 125, 126, 162, 197, 271/198, 287; 221/197, 198, 287; 109/24.1, 109/45–47; 902/9, 13
See application file for complete search history.

(56) References Cited

U.S. PATENT DOCUMENTS

| | | | | |
|---|---|---|---|---|
| 4,971,310 | A * | 11/1990 | Motegi et al. | 271/126 |
| 5,118,091 | A * | 6/1992 | Nagamoto et al. | 271/122 |
| 6,050,561 | A | 4/2000 | Kidokoro et al. | |
| 6,712,219 | B2 * | 3/2004 | Kobayashi et al. | 209/534 |
| 6,983,880 | B2 * | 1/2006 | Graef et al. | 235/379 |
| 7,240,829 | B2 * | 7/2007 | Graef et al. | 235/379 |
| 7,322,763 | B2 * | 1/2008 | Yang | 400/624 |
| 2002/0056960 | A1 * | 5/2002 | Bergeron et al. | 271/145 |
| 2002/0167123 | A1 | 11/2002 | Werner | |
| 2003/0062667 | A1 * | 4/2003 | Saltsov et al. | 271/3.14 |
| 2003/0192904 | A1 * | 10/2003 | Yu | 221/197 |
| 2004/0080094 | A1 * | 4/2004 | Dopfer | 271/122 |
| 2004/0108648 | A1 * | 6/2004 | Iida | 271/10.09 |
| 2004/0245709 | A1 * | 12/2004 | Takeuchi | 271/177 |
| 2005/0082738 | A1 * | 4/2005 | Bryant et al. | 271/10.01 |

FOREIGN PATENT DOCUMENTS

| | | | |
|---|---|---|---|
| DE | 199 05 337 | A1 | 8/2000 |
| DE | 101 18 981 | A1 | 10/2002 |
| GB | 976997 | | 12/1964 |
| JP | 59043745 | * | 3/1984 |
| JP | 9-120485 | | 5/1997 |

* cited by examiner

*Primary Examiner*—Patrick H Mackey
*Assistant Examiner*—Patrick Cicchino
(74) *Attorney, Agent, or Firm*—Nixon & Vanderhye, PC

(57) ABSTRACT

In a banknote handling device, a banknote storage cassette is loaded along guide grooves in left and right side plates, whereby the bottom end of a bill press interlocks with protruding members of the banknote storage cassette, preventing the banknote storage cassette from exiting the guide grooves, and, by sliding a lid of the banknote storage cassette, accumulated banknotes which are stored therein are transferred to a mounting plate while a free-sliding plate member inside a storage space of the banknote storage cassette presses the accumulated banknotes downward, the accumulated banknotes being separated one by one and conveyed down a transport path by a kick-out roller, a feeding roller, and a separating roller.

3 Claims, 10 Drawing Sheets

BANKNOTE HANDLING DEVICE

Priority is claimed on Japanese Patent Application No. 2004-361142, filed Dec. 14, 2004, the content of which is incorporated herein by reference.

BACKGROUND OF THE INVENTION

1. Field of the Invention

The present invention relates to a banknote handling device used in a mobile depositing device which, in a department store or the like where sale proceeds of a great number of cash registers and outlets are deposited in a communal area, is moved to positions where the cash registers are installed and some of the sale proceeds of the cash registers/outlets are deposited in the mobile depositing device.

2. Description of Related Art

Japanese Unexamined Patent Application, First Publication No. 9-120485 discloses a technique relating to a deposit system which, in a department store or the like including a great number of cash registers and outlets, is used in depositing sale proceeds of the cash registers and the outlets in a communal area including a plurality of deposit devices. In this deposit system, after the close of business of the cash registers and outlets that include cash registers, sale proceeds of each cash register and store are collected and deposited in deposit devices in the communal area. One or more intermediate deposits may be made during business hours, for reasons such as the high sum of daily sale proceeds of some of the cash registers/outlets.

A person who deposits cash from the cash registers/outlets goes to the communal deposit area and deposits the cash in one of the plurality of deposit devices.

However, to make an intermediate deposit during business hours, at least one member of staff must leave his register/store unattended. If the deposit is made by a management-level staff member, this management-level staff member must vacate his post, whereby it becomes difficult to make intermediate deposits.

SUMMARY OF THE INVENTION

Accordingly, it is an object of the present invention to provide a banknote handling device which, when used in a deposit system, enables intermediate deposits of sale proceeds from cash registers and outlets to be made easily during business hours.

In order to achieve the above objects, a banknote handling device of this invention includes left and right side plates which form left and right sides of a banknote mounting space, approximately horizontal guide grooves being formed in faces opposite the left and right side plates; a mounting plate which is provided between the side plates and slopes downward in a direction which banknotes are transported in; a front plate which is provided in the long direction of the guide grooves and extends approximately vertically from near a bottom end of the mounting plate with a handling space in between; a kick-out roller which is provided approximately in the center of the mounting plate, the kick-out roller contacting the banknotes set in the mounting plate and conveying them toward the handling space; a feeding roller and a separating roller which are provided near the handling space between the mounting plate and the front plate, and separate banknotes conveyed by the kick-out roller one by one while feeding them down the transport path; and a bill press which is supported by a supporting axle near the front plate such that the bill press can freely slide (or rotate) vertically. A stack of disparate banknotes or a banknote storage cassette storing accumulated banknotes is placed on the banknote mounting space, and the disparate banknotes or the accumulated banknotes are separated one by one and conveyed down to the transport path by the kick-out roller, the feeding roller and the separating roller.

In the banknote handling device of this invention, when loading the disparate banknotes, the disparate banknotes may be loaded into the banknote mounting space enclosed by the left and right side plates, the mounting plate and the front plate, and may be pushed to the kick-out roller by the bill press. The banknotes on the mounting plate are separated one by one and conveyed down the transport path by the kick-out roller, the feeding roller, and the separating roller.

In the banknote handling device of this invention, when loading the accumulated banknotes stored in the banknote storage cassette, the cassette may be loaded along the guide grooves in the left and right side plates, a bottom end of the bill press may interlock with protruding members of the banknote storage cassette and thereby prevents the banknote storage cassette from becoming removed from the guide grooves. The accumulated banknotes which are stored in the banknote storage cassette may be transferred to the mounting plate by sliding a lid thereof. A free-sliding plate member provided in a storage space inside the banknote storage cassette may push the accumulated banknotes to the kick-out roller, so that the accumulated banknotes are separated one by one and conveyed down the transport path by the kick-out roller, the feeding roller, and the separating roller.

In the banknote handling device of this invention, at least two of the guide grooves may be provided in each of the left and right side plates, the acceptance shapes of the two guide grooves being different.

In the banknote handling device of this invention, when loading the cassette, the height position where the bottom end of the bill press interlocks with the protruding members of the banknote storage cassette may be higher than the height position of the supporting axle of the bill press.

DETAILED DESCRIPTION OF THE INVENTION

A banknote handling device according to an embodiment of this invention will be explained with reference to the drawings.

Figure 1:
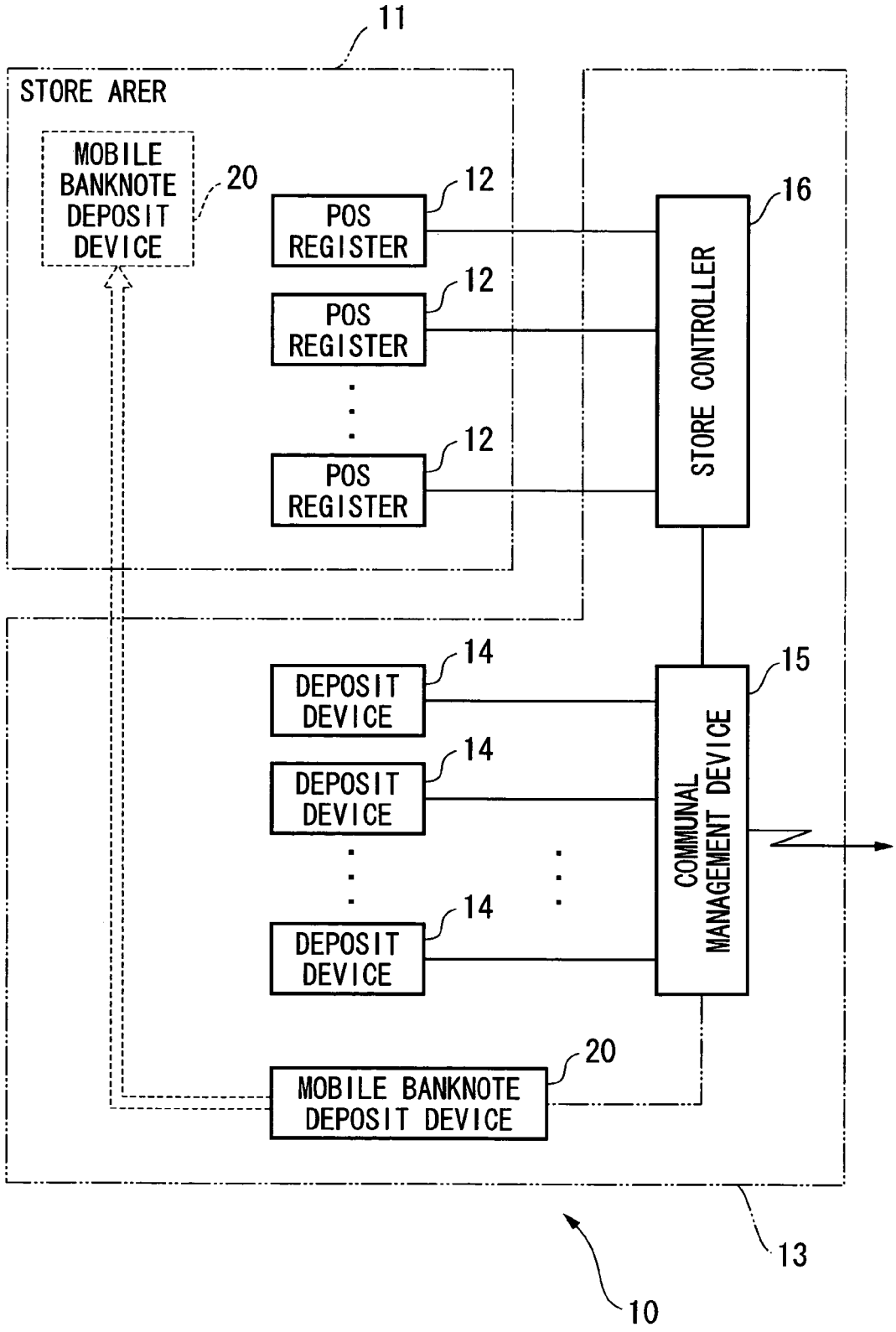
FIG. 1 is a block diagram of one example of a deposit system using a banknote handling device according to an embodiment of this invention.

A deposit system 10 according to an embodiment shown in FIG. 1 includes a great number of POS cash registers 12 which are installed in a store area 11 containing an great number of unidentified persons such as shoppers, such as a department store or a shopping center, and a plurality of deposit devices 14 which process the deposit of sale proceeds from the great number of POS cash registers 12 and are installed in a communal deposit room provided in a management area 13 which can be entered only by authorized persons, such as store staff and shopping center managers. The deposit system 10 also includes a communal management device 15 which manages the sale proceeds and the like. The communal management device 15 is connected to the plurality of deposit devices 14 and is installed in the deposit room or in a deposit management room adjacent thereto. Each of the POS cash registers 12 is connected to a store controller 16 to form a conventional POS system. The store controller 16 performs management and the like of the sale proceeds of the POS cash registers 12 and exchanges information with the communal management device 15.

When a deposit is made, identification information of the store and individual identification information of each POS cash register 12 are input to the deposit devices 14 as depositor information. In subsequent deposits, deposit sum information such as the deposited sum is stored in correlation with the depositor information. Coins and banknotes can be deposited in and withdrawn from each of the deposit devices 14, and deposited coins and banknotes can be withdrawn via a circulation system.

The communal management device 15 manages individual deposits for each depositor, store, or POS cash register 12, by storing the depositor information and deposit sum information sent from each of the deposit devices 14. That is, for each POS cash register 12, the communal management device 15 manages whether a deposit is made, the time of the deposit, the deposited sum, and so on. The communal management device 15 can output the depositor information and the deposited sum information it manages to the outside via a special-use line and a public line.

The deposit system 10 also includes a mobile banknote deposit device 20. As will be explained later, only banknotes can be deposited in the mobile banknote deposit device 20. Casters are attached to the casing of the mobile banknote deposit device 20, enabling it to move not only within the management area 13 but also within the store area 11. When the mobile banknote deposit device 20 is in the deposit room or in the deposit management room adjacent to the deposit room, it is connected by a cord to a commercial power source and power is supplied to it, enabling it to count and store deposits of banknotes in the same manner as the deposit devices 14. When the mobile banknote deposit device 20 moves within the store area 11 and approaches the outlets or the POS cash registers 12, power is supplied to it from a battery fitted inside the casing of the mobile banknote deposit device 20, enabling it to count and store deposits of banknotes. As with the deposit devices 14, when a deposit is made to the mobile banknote deposit device 20, identification information of the store and individual identification information of each POS cash register 12 are input thereto as depositor information. In subsequent deposits, the mobile banknote deposit device 20 stores deposit sum information such as the deposited sum in correlation with the depositor information.

When the mobile banknote deposit device 20 is in the deposit room or in the deposit management room adjacent to the deposit room, it is connected to the communal management device 15 via a wired or wireless system, and outputs depositor information and deposited sum information obtained when a deposit is made in the store area 11 to the communal management device 15.

Figure 2:
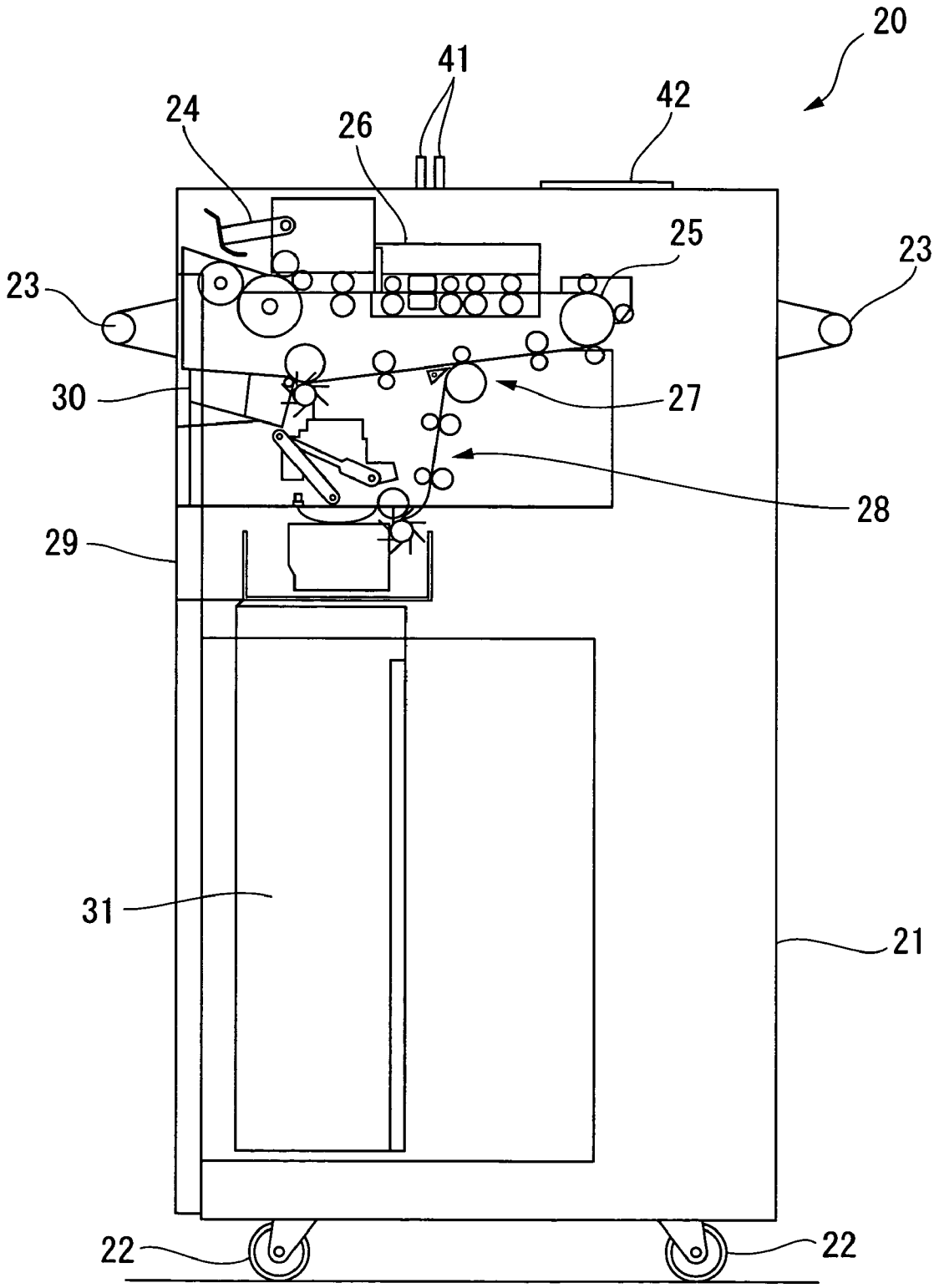
FIG. 2 is a schematic cross-sectional view of a mobile banknote deposit device used in the deposit system of FIG. 1.

FIG. 2 is a schematic configuration diagram of the mobile banknote deposit device 20. Casters 22 are attached below a casing 21 of the mobile banknote deposit device 20, and handles 23 are provided at the front and rear of the casing 21 so that a person who is collecting sales proceeds can move the device easily. A handling device 24 is provided at the upper front part of the casing 21 (upper left part in FIG. 2), and reels in inserted banknotes separately one by one. The banknotes which the handling device 24 reels out one by one are carried along a transport path to an authenticator 26. Notes which are authenticated as genuine are allocated by an allocator 27 to a downward carrier 28, and are temporarily accumulated in a temporary accumulator 29. Counterfeit notes which were not authenticated, notes which cannot be properly carried, and such like, are sent by the allocator 27 to a reject unit 30 at the front of the casing 21. The banknotes which are temporarily accumulated in the temporary accumulator 29 are stored in a banknote safe 31 at the bottom in accordance with an approval operation made by the depositor. In accordance with a cancellation operation made by the depositor, the temporary accumulator 29 can be extracted to the front of the casing 21 enabling him to remove the temporarily accumulated banknotes from the extracted temporary accumulator 29.

Figure 3:
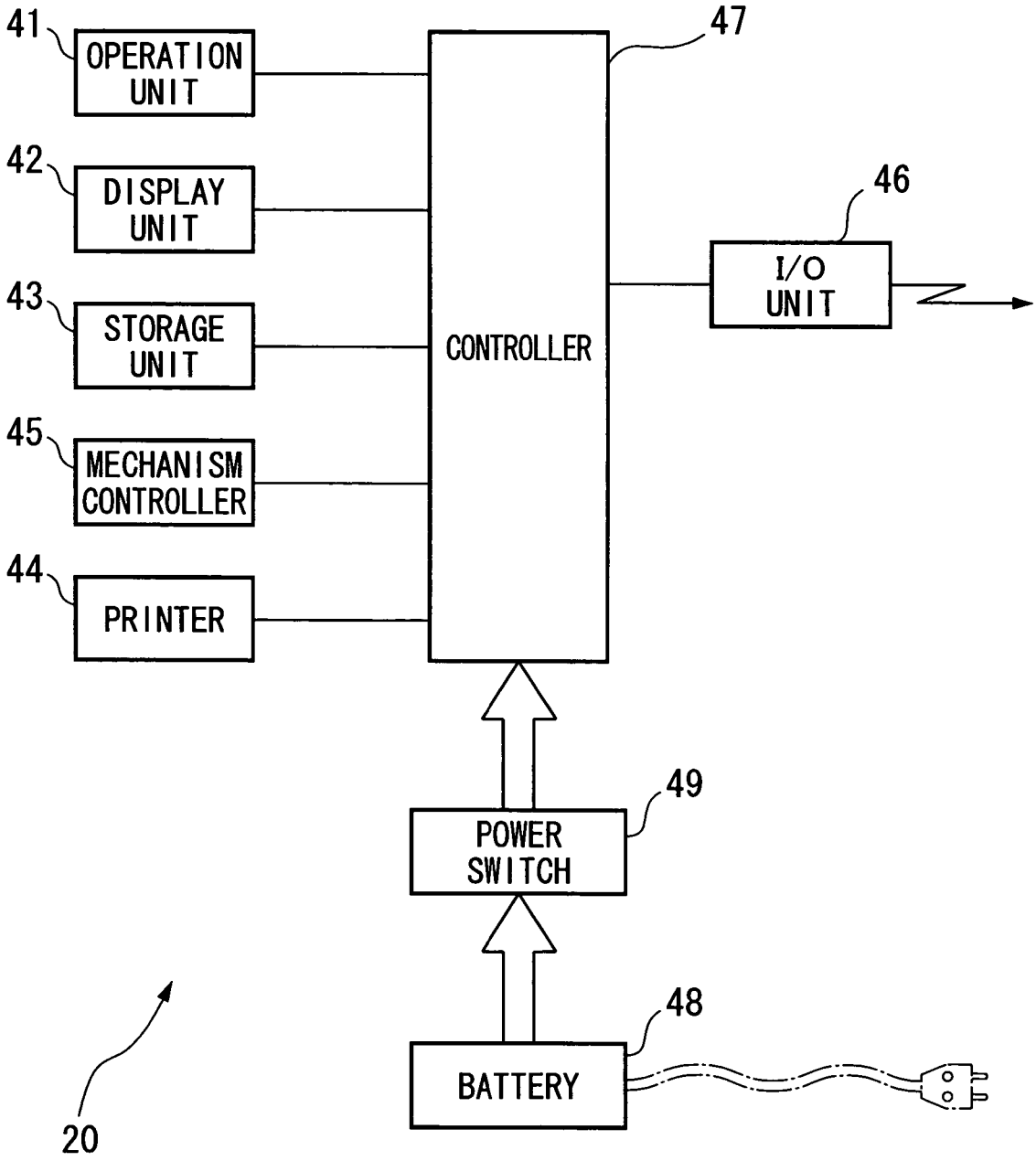
FIG. 3 is a block diagram of the mobile banknote deposit device of FIG. 2.

FIG. 3 is a block diagram of the mobile banknote deposit device 20. The mobile banknote deposit device 20 includes an operation unit 41, a display unit 42, a storage unit 43, a printer 44, a mechanism controller 45, and an input/output unit 46, which are connected to a controller 47 and are controlled thereby, The operation unit 41 includes a card-reader and a ten-key pad which enable depositor information to be input and can be used to issue commands to start counting deposits etc. The display unit 42 displays the operational status of the mobile banknote deposit device 20, depositor information and contents of commands to start counting deposits and such like which are input via the operation unit 41, the sum which is temporarily deposited in the temporary accumulator 29 during a deposit counting operation, and so on. The storage unit 43 stores depositor information together with deposited sum information relating to the sum of deposits in the banknote safe 31 in accordance with an approval operation, and so on. The printer 44 prints deposit transaction information such as the sum deposited by each depositor when the information is stored in accordance with an approval operation. The mechanism controller 45 drive-controls the mechanical parts of the mobile banknote deposit device 20. The input/output unit 46 is connected to the management device 15 by a wired or wireless system, and outputs the depositor information and the deposited sum information to the management device 15 when a deposit is made.

The mobile banknote deposit device 20 also includes a battery 48 and a power switch 49. When the mobile banknote deposit device 20 is connected to a commercial power source by a power cord, power for operating the entire device 20 and power for charging the battery 48 are supplied by switching the power switch 49 to ON. When the power cord is disconnected, the battery 48 supplies power for operating the entire mobile banknote deposit device 20 when the power switch 49 is switched to ON.

As described above, the mobile banknote deposit device 20 not only counts and stores deposits in the management area 13 which can be entered only by authorized persons, such as store staff and shopping center managers, but can also be used near the cash registers and outlets when depositing banknotes forming part of the sale proceeds. Consequently, when counting and storing deposits in the store area 11, the handling device 24 of the mobile banknote deposit device 20 sets the banknotes which form part of the sale proceeds without alteration and starts counting them. This is not desirable from a security point of view, since a great number of exposed banknotes can be easily seen by a great number of unidentified persons.

Accordingly, in this deposit system 10, identically shaped banknote storage cassettes 60 which can be loaded with part of the sale proceeds are provided at each of at least some of the cash registers and outlets. Each banknote storage cassette 60 can be mounted in the mobile banknote deposit device 20, which receives the sale proceeds from the banknote storage cassette 60 mounted therein and authenticates, counts, and stores the deposited cash while being powered by the battery 48. This makes it more difficult for the great number of unidentified persons to notice the great number of banknotes being counted and deposited.

Figure 4:
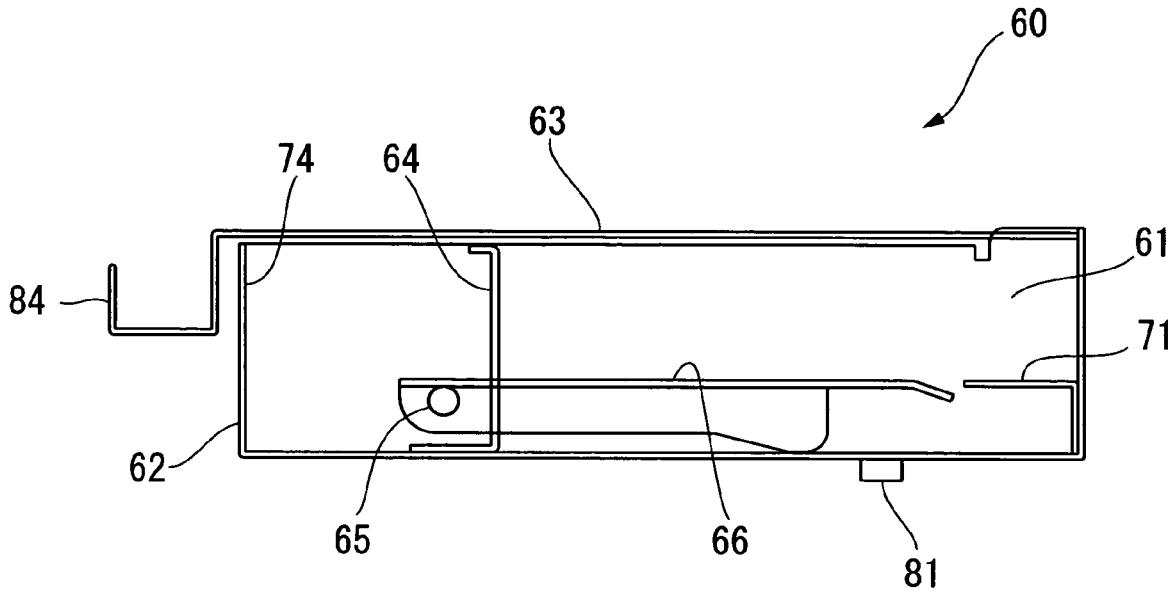
FIG. 4 is a cross-sectional view taken from the side direction of a banknote storage cassette used in the deposit system of FIG. 1.
Figure 5:
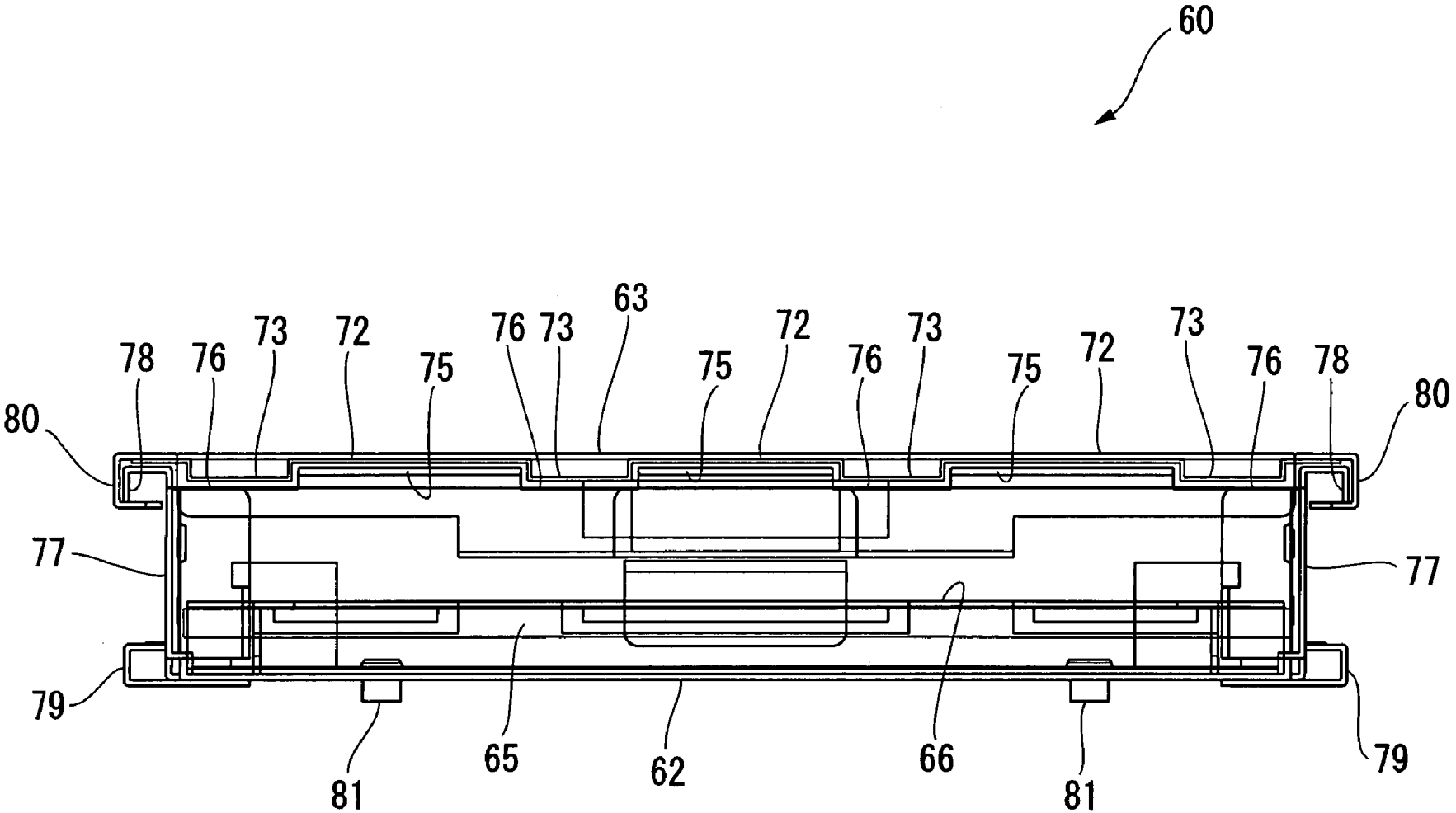
FIG. 5 is a perspective view taken from the front direction of the banknote storage cassette of FIG. 4.
Figure 6:
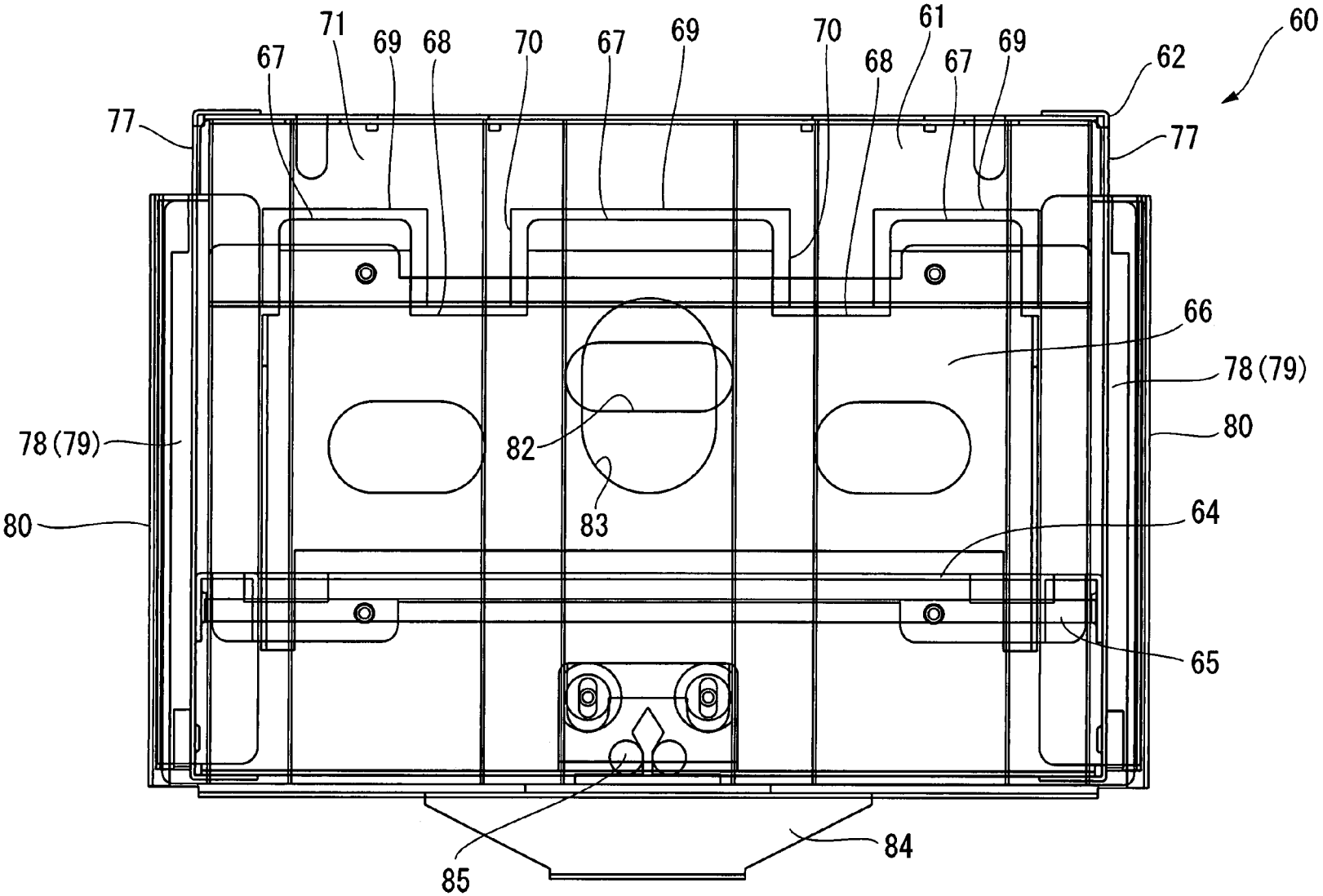
FIG. 6 is a perspective view taken from the plane direction of the banknote storage cassette of FIG. 4.

FIGS. 4 to 6 are diagrams of the banknote storage cassette 60. FIG. 4 is a central cross-sectional view from the side, FIG. 5 is a perspective view from the front, and FIG. 6 is a perspective view along the plane.

The banknote storage cassette 60 is a box consisting of an approximately rectangular concave frame 62 which includes a storage space 61 where banknotes can be collected, and a lid 63 which opens and closes the storage space 61 of the concave frame 62 by sliding. An inner wall 64 is provided inside the concave frame 62 and forms one side face of the storage space 61, and, on the extraction side (left side of FIG. 4) of the inner wall 64, a plate member 66 is supported around a slide supporting axle 65 which is parallel to the lid 63 such that the plate member 66 can slide (or rotate) to the lid 63 side. As shown in FIG. 4, when the lid 63 of the cassette 60 is moved to the top, the plate member 66 becomes approximately horizontal. As shown in FIG. 6, convex sections 67 alternate with concave sections 68 at the sliding tip of the plate member 66. In the storage space 61 of the concave frame 62, a supporting stand 71 is provided opposite the plate member 66. Concave sections 69 and convex sections 70 are formed at the tip of the supporting stand 71 and are staggered with the convex sections 67 and the concave sections 68 of the plate member 66. When the plate member 66 is approximately horizontal, the supporting stand 71 is at approximately the same height as the plate member 66. The storage space 61 is slightly wider than a banknote.

Concave grooves 72 and convex grooves 73 are formed in the inner face of the storage space 61 side of the lid 63 and are parallel to the direction which the lid 63 slides in. At the top of the inner wall 64 and the top end of a side wall 74 where the lid 63 of the concave frame 62 slides, the concave grooves 72 and the convex grooves 73 in the inner face of the lid 63 respectively interlock with convex sections 75 and concave sections 76. That is, the lid 63 slides along the convex sections 75 and the concave sections 76.

When the lid 63 of the cassette 60 is at the bottom, if the lid 63 is slid so as to open the storage space 61, banknotes collected in the storage space 61 are guided to the inner wall 64 and drop to the bottom approximately in their collected arrangement.

Two approximately straight parallel guiders 78 and 79 are attached to left and right side walls 77, which are approximately parallel to the direction which the lid 63 of the concave frame 62 slides in, the parallel guiders 78 and 79 also being parallel to the sliding direction of the lid 63. Of these guiders 78 and 79 of the concave frame 62, the parallel guiders 78 near the lid 63 also function as guiding members for the lid 63.

The lid 63 includes guided sections 80 which are guided by the parallel guiders 78, the outer peripheral shape of these guided sections 80 being approximately straight and of a different size than the outer peripheral shape of the parallel guiders 79.

Protruding members 81 are provided on the outer face of the concave frame 62 opposite the lid 63. A peep window 82 (FIG. 6) is provided at least in the face of the concave frame 62 which is opposite the lid, and a peephole 83 which connects to the peep window 82 is provided in the plate member 66 inside the storage space 61. By looking through the peep window 82 and the peephole 83 from the opposite side of the lid 63 of the banknote storage cassette 60, it is possible to ascertain whether banknotes are stored in the storage space 61 of the banknote storage cassette 60. The lid 63 has a handle 84 for gripping the lid 63 when sliding it. The cassette 60 has a catcher member 85 which, when the storage space 61 is closed by sliding the lid 63, prevents the lid 63 from sliding.

The plate member 66 inside the storage space 61 has a predetermined weight; more specifically, its weight corresponds to that of a bill press 99 which is fitted to the handling device 24 of the mobile banknote deposit device 20 and will be explained later.

Figure 7:
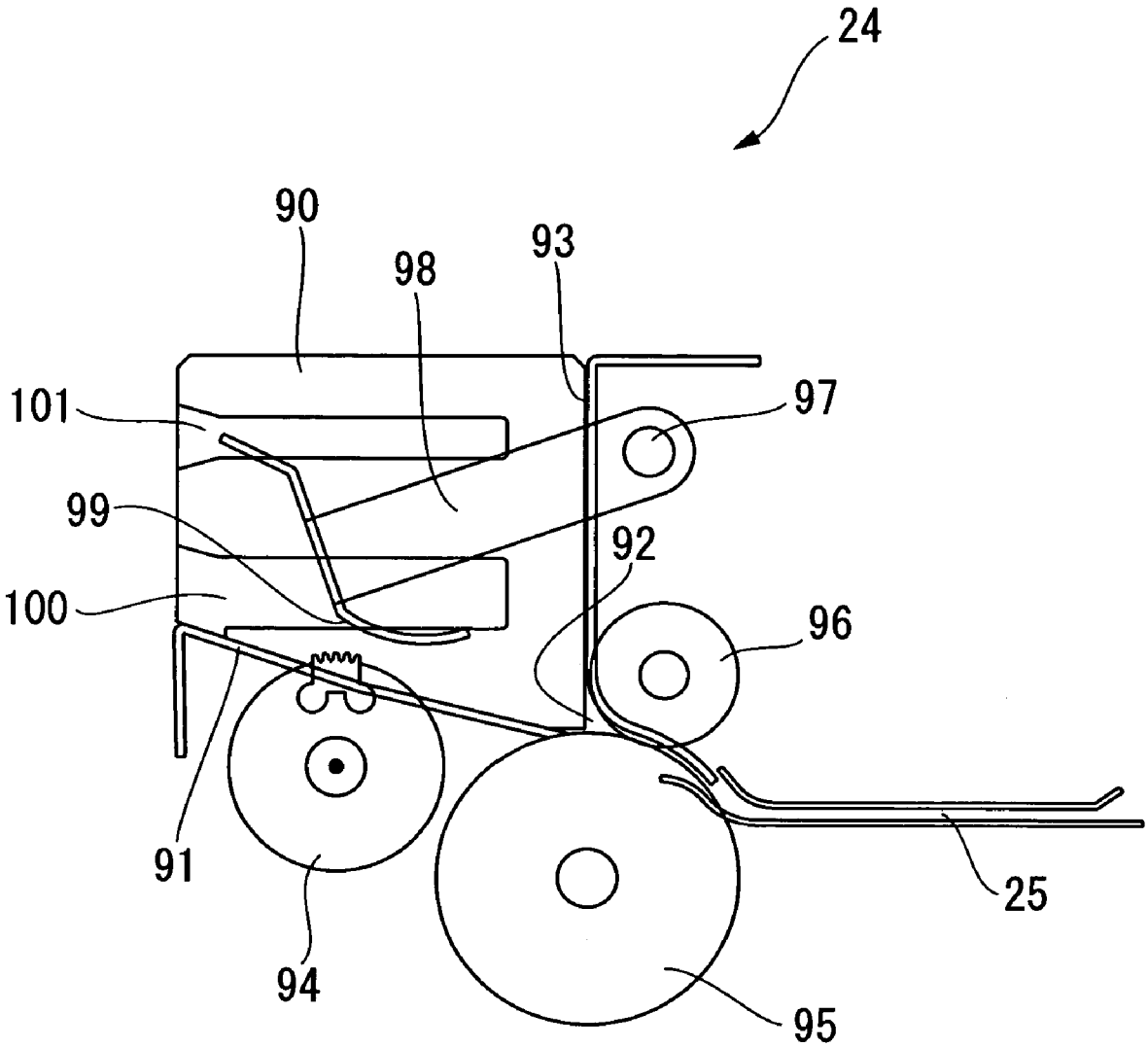
FIG. 7 is a side view of a banknote handling device according to an embodiment of this invention used in the mobile deposit device of FIG. 2.
Figure 8:
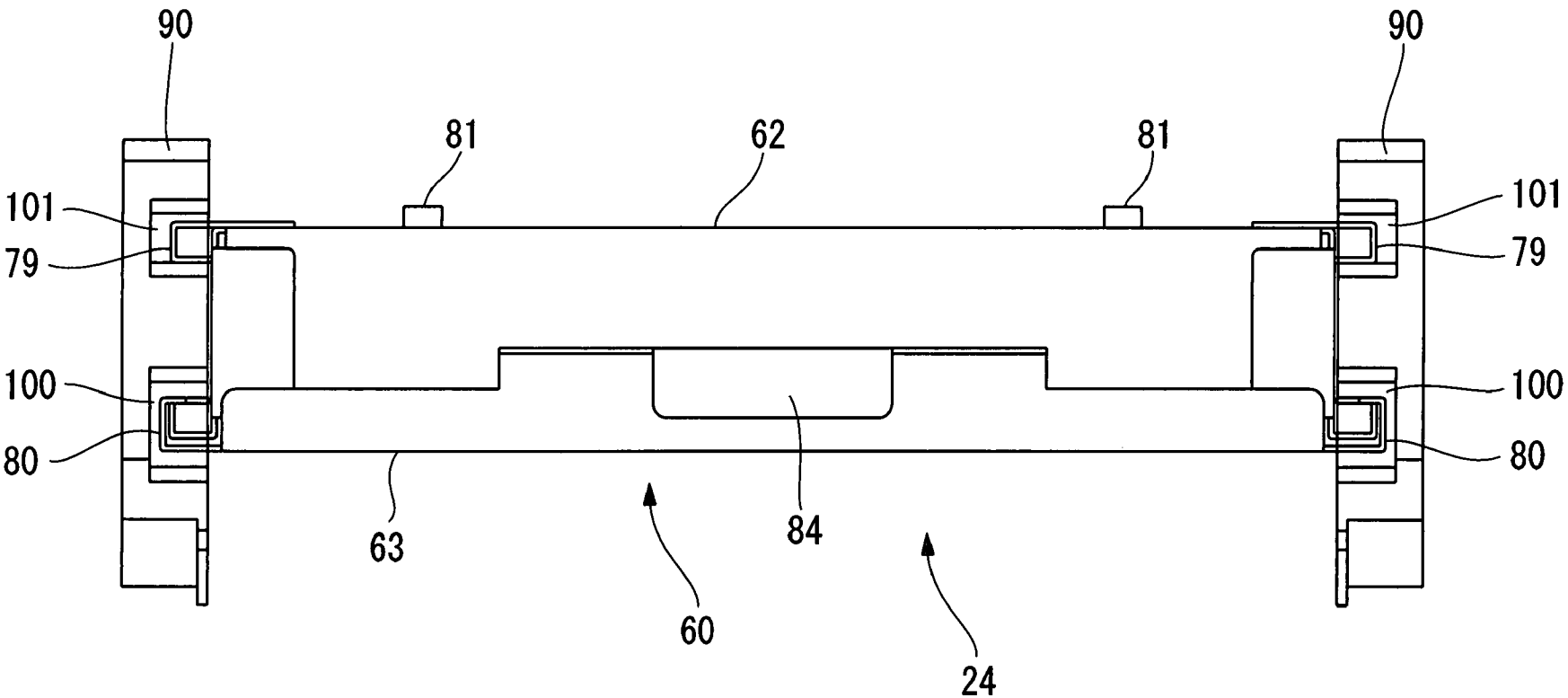
FIG. 8 is a partial front view of a state when a banknote storage cassette is loaded into the banknote handling device according to an embodiment of this invention.

FIG. 7 is a detailed diagram of the handling device 24 of the mobile banknote deposit device 20, and FIG. 8 is a diagram of the state when the banknote storage cassette 60 is loaded into the handling device 24.

Side plates 90 are provided on the left and right sides of the handling device 24. A mounting plate 91 is provided between the side plates 90 and slopes downwards toward the rear of the casing 21 (right side of FIG. 7). An approximately vertical front plate 93 is provided near the bottom end of the mounting plate 91 with a handling space 92 in between. In the center of the sloping part of the mounting plate 91 is a kick-out roller 94 which contacts a banknote set on the mounting plate 91 and feeds it toward the handling space 92. A feeding roller 95 and a separating roller 96 are provided near the handling space 92 between the mounting plate 91 and the front plate 93. The rollers 95 and 96 individually separate banknotes which are fed out from the kick-out roller 94 and send them down a transport path 25. In front of the front plate 93 (right side of FIG. 7), a horizontal supporting axle 97 supports two arms 98 (only one is shown in FIG. 7) such that they can freely slide (or rotate) in a vertical direction. At the sliding end of the arms 98, a curved bottom part of a bill press 99 presses from above onto banknotes mounted on the mounting plate 91 and pushes them toward the kick-out roller 94.

Two guide grooves 100 and 101 are respectively formed in the faces opposite the left and right side plates 90 of the handling device 24, and extend approximately horizontally toward the front plate 93. The height of the guide grooves 100 is greater than that of the guide grooves 101. The guide grooves 100 and 101 have wide entrances. The guided sections 80 of the lid 63 of the banknote storage cassette 60 are inserted into the guide grooves 100, and the parallel guiders 79 provided on the concave frame 62 of the banknote storage cassette 60 are inserted into the guide grooves 101. As shown in FIG. 8, the banknote storage cassette 60 is loaded into the handling device 24 with the lid 63 at the bottom.

Figure 9:
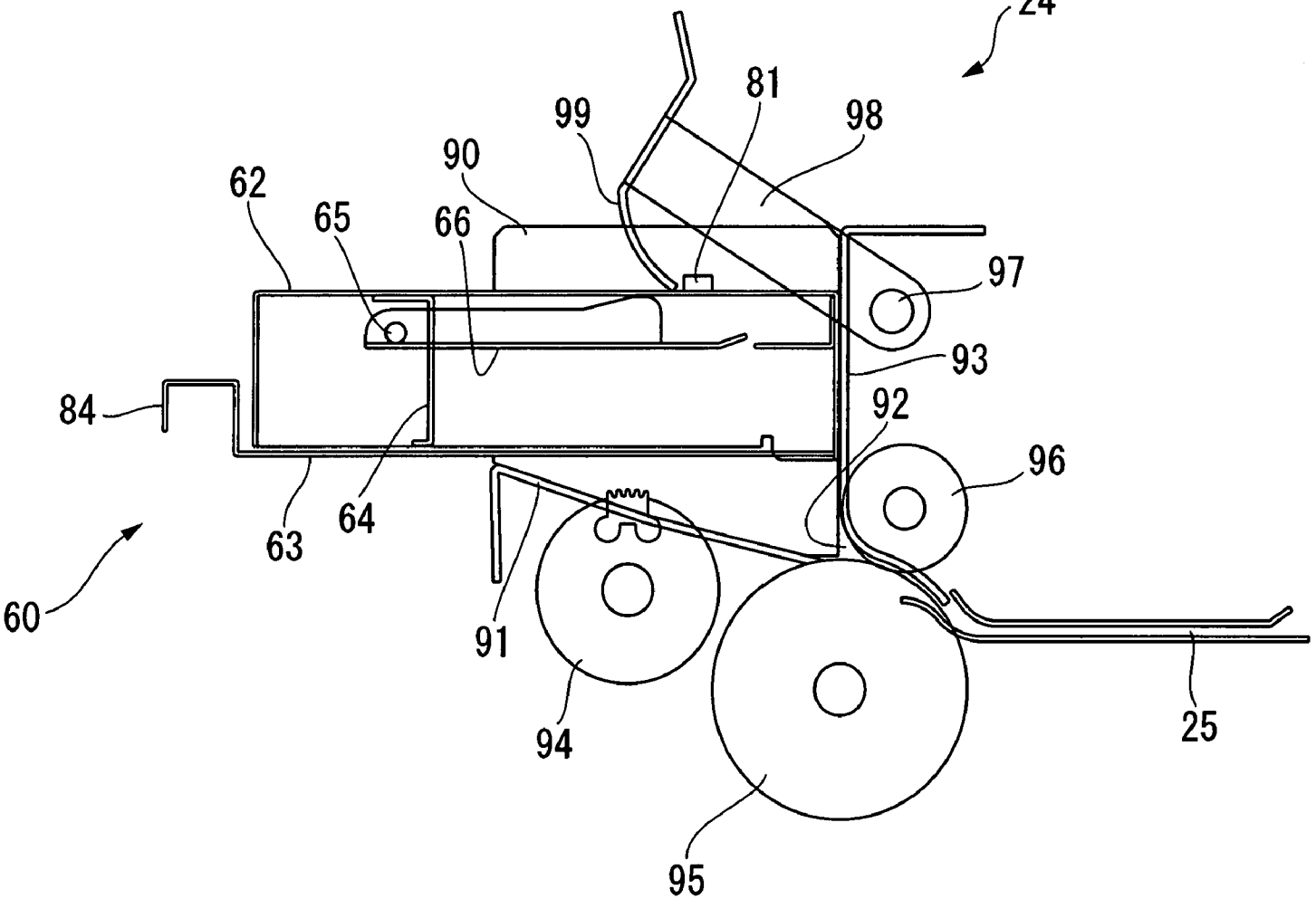
FIG. 9 is a side view of a state immediately after a banknote storage cassette is loaded into the banknote handling device according to an embodiment of this invention.
Figure 10:
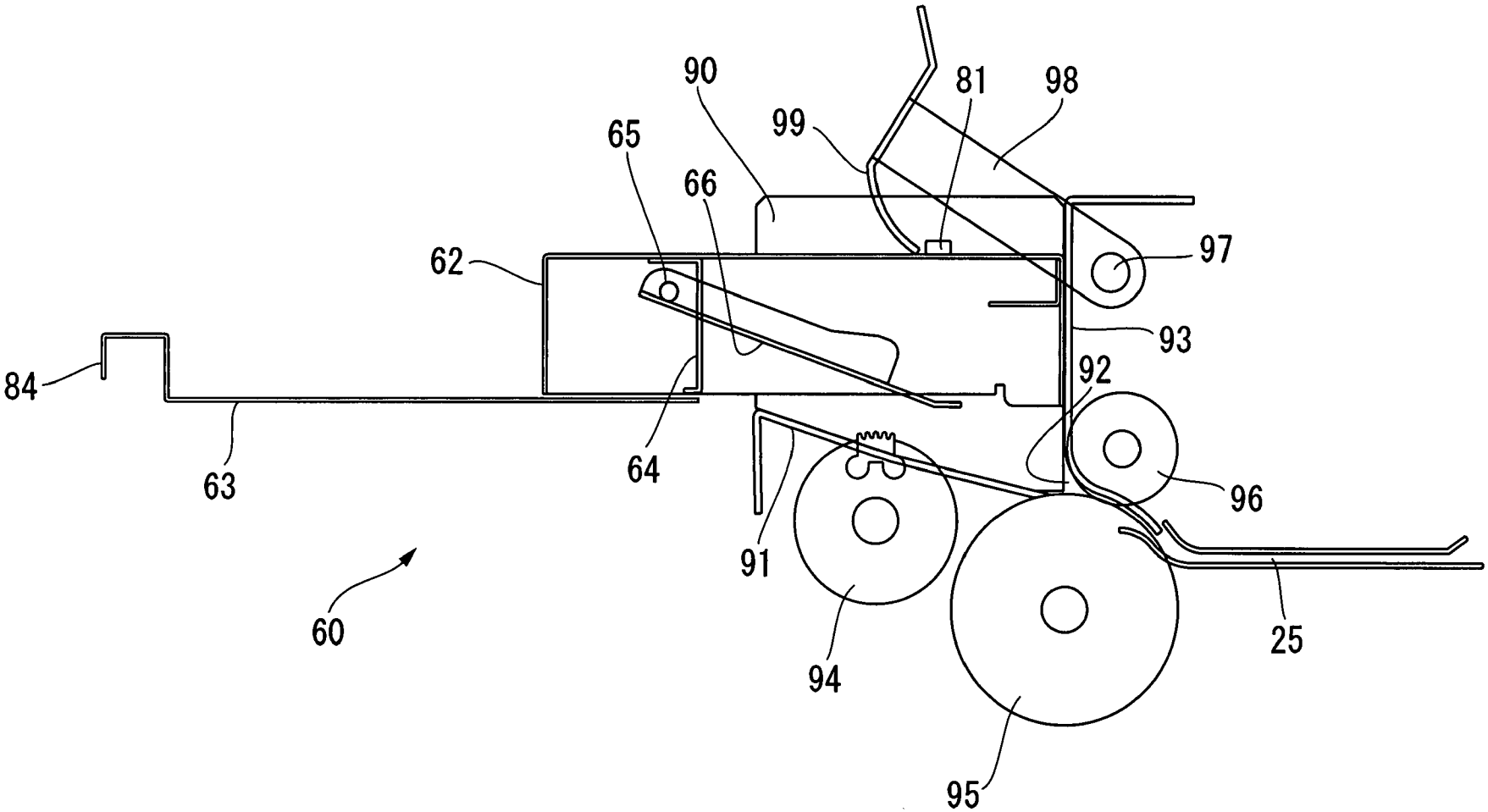
FIG. 10 is a side view of a state when sliding a lid of banknote storage cassette which is loaded into the banknote handling device according to an embodiment of this invention.

FIG. 9 is a diagram of the state immediately after the banknote storage cassette 60 is loaded into the handling device 24 of the mobile banknote deposit device 20, and FIG. 10 is a diagram of the state when the lid 63 of the banknote storage cassette 60 is slid into place. The bill press 99 is supported around the supporting axle 97 by the two arms 98 such that it can freely slide (or rotate) in the vertical direction. The height position of the supporting axle 97 is slightly lower than the height position of the uppermost face of the concave frame 62 when the banknote storage cassette 60 is loaded into the handling device 24. Therefore, after an operator lifts the bill press 99 and loads the banknote storage cassette 60 into the handling device 24, when the operator removes his hand from the bill press 99, the bottom end of the bill press 99 drops to a position where it touches the face of the protruding member 81 of the banknote storage cassette 60 which is opposite the supporting axle 97.

When the lid 63 of the banknote storage cassette 60 is slid so as to open the storage space 61, the sliding tip of the plate member 66 inside the storage space 61 drops due to its own weight, and the banknote stored in the storage space 61 is transferred to the mounting plate 91 and pressed from above by the kick-out roller 94.

In the deposit system 10 according to the embodiment described above, during collection of sale proceeds from the outlets/POS cash registers 12 after the close of business, a depositor of the outlets/POS cash registers 12 goes to a communal deposit room or the like in the management area 13 where he uses one of the great number of deposit devices 14 provided there to deposit the sale proceeds by inserting banknotes and coins while inputting the depositor information, and stores the deposited sum information in correlation therewith.

When making a deposit during business hours, with regard to sale proceeds from some of the outlets/POS cash registers 12, a person who is responsible for collecting these sale proceeds makes a routine visit with the mobile banknote deposit device 20 at a predetermined time, or visits with the mobile banknote deposit device 20 as required when he is requested to do so. Part of the sale proceeds can be deposited in the mobile banknote deposit device 20 when it nears the outlets/POS cash registers 12. Some of the outlets/POS cash registers 12 making intermediate deposits at this time store some of the banknotes which form part of the sale proceeds in banknote storage cassettes 60 which were individually distributed to them beforehand. A staff member opens the storage space 61 by positioning the lid 63 of the banknote storage cassette 60 at the top, gripping the handle 84, and sliding the lid 63 with respect to the concave frame 62. He loads the banknotes to be deposited in a collected state across the supporting stand 71 and the plate member 66 of the storage space 61, replaces the lid 63 over the concave frame 62, slides it in the opposite direction to close the storage space 61, and seals it with the catcher member 85.

When the person who is responsible for collecting the sale proceeds moves the mobile banknote deposit device 20 near an outlet/POS cash register 12 intending to make an intermediate deposit and switches the power switch 49 to ON, even if this is a place where the power cord cannot be connected to a commercial power source, the battery 48 starts to supply power, and, on condition that the battery 48 is sufficiently charged, an initial setting operation is performed to enable a deposit to be processed.

As shown in FIG. 9, the banknote storage cassette 60 containing the banknotes for intermediate deposit is then reversed to a state which is opposite that when collecting the banknotes such that the lid 63 is at the bottom, and the handling device 24 of the mobile banknote deposit device 20 is set. That is, with the bill press 99 kept at the top, the tips of the guided sections 80 which form the bottoms of both sides of the banknote storage cassette 60 are fitted into the guide grooves 100 of the two side plates 90 of the handling device 24. The tips of the parallel guiders 79 which form the tops of both sides of the banknote storage cassette 60 are then fitted into the guide grooves 101 of the two side plates 90 of the handling device 24. The banknote storage cassette 60 is positioned approximately horizontally, and its tip is pressed until it touches/abuts to the front plate 93.

The bill press 99 cancels a state where the banknote storage cassette 60 is pressed toward the front plate 93, and a state where the operator takes his hand away while pressing the banknote storage cassette 60 and removes it upwardly. In these states, the protruding members 81 and 81 at the top side of the banknote storage cassette 60 are set at positions slightly to the front plate 93 side of the bottom end of the bill press 99, which abuts to the concave frame 62 at the top face side of the banknote storage cassette 60 due to its own weight. In this state, due to the weight of the plate member 66 inside the banknote storage cassette 60 and the accumulated weight of the banknotes stored in the storage space 61, the tip of the plate member 66 is tilted by an appropriate degree around the slide supporting axle 65 to the lid 63 side, thereby pressing the stored banknotes from above.

Next, as shown in FIG. 10, the operator grips the handle 84 of the lid 63 and slides the lid 63 in the rearward horizontal direction (to the left of FIG. 10) while resisting the holding force of the catcher member 85. Due to the holding force of the catcher member 85, the concave frame 62 also attempts to slide in the same direction as the lid 63. However, since the protruding members 81 on the top face of the concave frame 62 interlock with the bottom end of the bill press 99 which abuts to the top face of the concave frame 62, and since the interlock height position of the protruding members 81 and the bottom end of the bill press 99 is slightly higher than the higher position of the supporting axle 97 which supports the bill press 99 such that it can freely slide (or rotate downward), the force of the protruding members 81 which press the bottom end of the bill press 99 and attempt to slide it is overcome by the force of the bottom end of the bill press 99 which attempts to interlock with the protruding members 81. Consequently, the concave frame 62 stops in this position, and only the lid 63 slides horizontally rearward.

The banknotes are accumulated in the concave and convex grooves 72 and 73 in the inner face of the lid 63, and are pressed from above by the weight of the plate member 66. As the lid 63 slides horizontally rearward, the weight of the plate member 66 causes it to rotate in a clockwise direction as shown in FIG. 10. The concave and convex sections 75 and 76 of the inner wall 64 prevent the banknotes from being pulled in the sliding direction of the lid 63, and the banknotes remain in the accumulated state while the handling device 24 is transferred from the storage space 61 of the banknote storage cassette 60 onto the mounting plate 91.

In this state, the depositor operates the operation unit 41 consisting of a card-reader, a ten-key pad, or the like, in compliance with the display contents of the display unit 42 of the mobile banknote deposit device 20 to input the depositor information and start counting the deposit. Since the banknotes mounted on the mounting plate 91 of the handling device 24 are being pressed against the kick-out roller 94 from above by the plate member 66 of the banknote storage cassette 60, the action of the kick-out roller 94, the feeding roller 95, and the separating roller 96, which are controlled by the mechanism controller 45, conveys the banknotes on the mounting plate 91 from the handling device 24 onto the transport path 25 one by one. From there, the conveyed banknotes are authenticated by the authenticator 26 in the same manner as in a conventional banknote deposit device. Notes which are authenticated as genuine are allocated by the allocator 27 to the downward carrier 28 and temporarily accumulated in the temporary accumulator 29. Counterfeit notes which were not authenticated as genuine, notes which cannot be properly carried, and such like, are sent by the allocator 27 to the reject unit 30 at the front of the casing 21.

The controller 47 of the mobile banknote deposit device 20 uses the authenticator 26 or various sensors along the transport path 25 to detect whether a conveyed banknote has not been detected for a predetermined period of time. If a banknote is not detected for the predetermined period of time, the controller 47 determines that all the banknotes on the mounting plate 91 of the handling device 24 have been conveyed from the storage space 61 of the banknote storage cassette 60, and uses the mechanism controller 45 to stop the conveying/transporting process which is performed by the kick-out roller 94, the feeding roller 95, the separating roller 96, and the transport path 25. Thereafter, the total deposited sum of the banknotes authenticated by the authenticator 26 and the like is displayed, and, based on this display, the depositor uses the operation unit 41 to approve or cancel. If the depositor approves, the banknotes temporarily accumulated in the temporary accumulator 29 are stored in the banknote safe 31 below. If he cancels, the temporary accumulator 29 can be extracted at the front of the casing 21 and the banknotes can be removed from the extracted temporary accumulator 29. When he approves, the printer 44 prints transaction date information, depositor information, deposited sum information, and the like, as evidence that a deposit has been made in the mobile banknote deposit device 20. This printout is delivered to the depositor and also stored in the storage unit 43.

When the controller 47 of the mobile banknote deposit device 20 determines that all the banknotes mounted on the mounting plate 91 have been conveyed and uses the mechanism controller 45 to stop the conveying/transporting process, the depositor may determine whether all the banknotes mounted on the mounting plate 91 have been conveyed from the banknote storage cassette 60 by confirming the total deposited sum and the like of the banknotes which is displayed by the display unit 42. Alternatively, he may directly confirm by sight whether there are any banknotes on the mounting plate 91 by peering through the peep window 82 in the concave frame 62 in the top face of the banknote storage cassette 60 which is attached to the handling device 24, and through the peephole 83 in the plate member 66 while it is slid toward the mounting plate 91 below the internal storage space 61. He can also confirm whether there are any banknotes in the storage space 61 when the banknote storage cassette 60 is in its single piece state and the storage space 61 is closed by the lid 63, by looking through the peep window 82 of the concave frame 62 and the peephole 83 of the plate member 66.

When the intermediate deposit ends as described above, the depositor presses the lid 63 to close the storage space 61 of the concave frame 62, and seals the lid 63 over the storage space 61 by using the catcher member 85. The depositor then lifts the bill press 99 upwards and releases the lock between the bottom of the bill press 99 and the protruding member 81 on the top face of the concave frame 62. Holding the handle 84 and the concave frame 62, he pulls the banknote storage cassette 60 horizontally out from the handling device 24.

When making an intermediate deposit from a nearby outlet/POS cash register 12, the depositor repeats the above operation. To make an intermediate deposit from an outlet/POS cash register 12 in another location, he momentarily turns the power switch 49 to OFF while he moves the mobile banknote deposit device 20 to that location.

In this way, intermediate deposits are made by moving the mobile banknote deposit device 20 within the store area 11 to some of the outlets/POS cash registers 12, the process ending when the mobile banknote deposit device 20 is moved near the communal management device 15 for managing sale proceeds and the like which is installed in a deposit room or a deposit management room adjacent thereto in the management area 13. By using the power cord to connect the mobile banknote deposit device 20 to a commercial power source and switching the power switch 49 to ON, the mobile banknote deposit device 20 can be operated by the power supply from the commercial power source while recharging the battery 48.

When the mobile banknote deposit device 20 moves near the communal management device 15, the communal management device 15 and the mobile banknote deposit device 20 are connected by a wired or wireless method. The depositor information and the deposited sum information relating to deposits made with the mobile banknote deposit device 20 are output from the input/output unit 46 to the communal management device 15. The communal management device 15 stores the depositor information together with the deposited sum information from the great number of deposit devices 14, and manages the individual deposit statuses of each outlet and each POS cash register 12. The depositor information and the deposited sum information stored in this manner are output to the outside via a special-use line and a public line after a predetermined closing operation.

When the banknote storage cassette 60 is set in the handling device 24, the mobile banknote deposit device 20 can count the deposits in the manner described above. Irrespective of the banknote storage cassette 60, it is possible to count a deposit consisting of a mixture of disparate banknotes. When counting a deposit consisting of disparate banknotes, the disparate banknotes are loaded into a banknote mounting space which is enclosed by the left and right side plates 90, the mounting plate 91, and the front plate 93, and pushed by the bill press 99 toward the kick-out roller 94. The disparate banknotes are separated one by one from the mounting plate 91 by the kick-out roller 94, the feeding roller 95, and the separating roller 96, and sent down the transport path 25.

According to the deposit system according to the embodiment described above, the guide grooves 100 and 101 are formed in faces opposite the left and right side plates 90 and extend approximately horizontally toward the front plate 93. When loading disparate banknotes, the disparate banknotes are loaded into the banknote mounting space enclosed by the left and right side plates 90, the mounting plate 91, and the front plate 93, pushed to the kick-out roller by the bill press 99. The disparate banknotes on the mounting plate 91 can be separated one by one and conveyed down the transport path by the kick-out roller 94, the feeding roller 95, and the separating roller 96. When loading the banknote storage cassette 60, the banknote storage cassette 60 is loaded along the guide grooves 100 and 101 in the left and right side plates, and the bottom end of the bill press 99 interlocks with the protruding members 81 of the banknote storage cassette, preventing the banknote storage cassette 60 from becoming removed from the guide grooves 100 and 101. In addition, by sliding the lid 63 of the banknote storage cassette 60, the banknotes accumulated therein are transferred to the mounting plate 91, and the free-sliding plate member 66 provided in the storage space 61 of the banknote storage cassette 60 pushes them downwards. The banknotes accumulated on the mounting plate 91 can then be separated one by one and conveyed down the transport path 25 by the kick-out roller 94, the feeding roller 95, and the separating roller 96. Therefore, in addition to loading the disparate banknotes onto the mounting plate 91 and counting the deposit, it is also possible to load the banknote storage cassette 60 into the banknote storage space and count the deposit.

It is acceptable to provide at least two or more of the guide grooves 100 and 101 in each of the left and right side plates, and to make the acceptance shapes of at least two of the guide grooves 100 and 101 different. When the banknote storage cassette 60 is loaded into the banknote storage space, the parallel guiders 78 and 79, which are formed in the banknote storage cassette 60 and have different shapes, allow the banknote storage cassette 60 to be attached in the two guide grooves 100 and 101 which have different shapes. This prevents any mistakes in the attachment direction.

Further, when loading the banknote storage cassette 60, the height position where the bottom end of the bill press 99 interlocks with the protruding members 81 of the banknote storage cassette 60 is higher than the height position of the supporting axle 97 of the bill press 99. Therefore, at the time of removing the lid 63 of the banknote storage cassette 60, although the protruding members 81 of the concave frame 62 are about to be removed, the bottom end of the bill press 99 interlocks with them and restricts the removal of the concave frame 62, enabling only the lid 63 to be opened.

As described above, this invention makes it possible to select one of two loading methods, namely, loading disparate notes onto the banknote mounting plate and counting the deposit, and loading a banknote storage cassette into the banknote storage space and counting the deposit.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A banknote handling device comprising:

left and right side plates which form left and right sides of a banknote mounting space, approximately horizontal guide grooves being formed in faces opposite said left and right side plates;

a mounting plate which is provided between said side plates and slopes downward in a direction in which banknotes are to be transported;

a front plate which is provided in an elongated direction of said guide grooves and extends approximately vertically from near a bottom end of said mounting plate with a handling space for said banknotes between said bottom end;

a kick-out roller which is provided approximately in the center of said mounting plate, said kick-out roller contacting the banknotes set in said mounting plate and conveying them toward said handling space;

a feeding roller and a separating roller which are provided near said handling space between said mounting plate and said front plate, and separate the banknotes conveyed by said kick-out roller one by one while feeding them down to a transport path; and a bill press which is supported by a supporting axle near said front plate such that said bill press can freely slide vertically; wherein a stack of disparate banknotes or a banknote storage cassette storing accumulated banknotes is placed on said banknote mounting space, said disparate banknotes or said accumulated banknotes being separated one by one and conveyed down to said transport path by said kick-out roller, said feeding roller and said separating roller;

when loading said accumulated banknotes stored in said banknote storage cassette which is formed with a protruding member and provided with a sliding lid and a free-sliding plate member in a storage space inside said banknote storage cassette, said banknote storage cassette is loaded along said guide grooves in said left and right side plates, and prevented from becoming removed from said guide grooves by interlocking a bottom end of said bill press with said protruding members of said banknote storage cassette; and said accumulated banknotes stored in said banknote storage cassette are transferred to said mounting plate by sliding said sliding lid, pushed to said kick-out roller by said free-sliding plate member, separated one by one and conveyed down to said transport path by said kick-out roller, said feeding roller and said separating roller; and when loading said disparate banknotes, said disparate banknotes are loaded into said banknote mounting space enclosed by said left and right side plates, said mounting plate and said front plate, pushed to said kick-out roller by said bill press, and separated one by one and conveyed down to said transport path by said kick-out roller, said feeding roller and said separating roller.

2. The banknote handling device according to claim 1, wherein at least two of the guide grooves are provided in each of said left and right side plates, and acceptance shapes, to which said banknote storage cassette is loaded, of the two guide grooves are different.

3. The banknote handling device according to claim 1, wherein a height position where said bottom end of said bill press interlocks with said protruding members of said banknote storage cassette is higher than a height position of the supporting axle of said bill press when said banknote storage cassette is loaded to said banknote handling device.

* * * * *